10/15/85 CR 4,546,624

United States Patent [19]

von der Eltz et al.

[11] Patent Number: 4,546,624

[45] Date of Patent: Oct. 15, 1985

[54] DEVICE FOR THE CONTINUOUS DYEING AND/OR FINISHING OF WET TEXTILE WEBS

[75] Inventors: Hans-Ulrich von der Eltz, Frankfurt am Main; Peter Oppitz, Kelkheim, both of Fed. Rep. of Germany

[73] Assignee: Hoechst Aktiengesellschaft, Fed. Rep. of Germany

[21] Appl. No.: 488,035

[22] Filed: Apr. 25, 1983

[30] Foreign Application Priority Data

May 5, 1982 [DE] Fed. Rep. of Germany ..... 3216731

[51] Int. Cl.[4] ..... D06B 23/26

[52] U.S. Cl. ..... 68/13 R; 68/22 R; 68/207; 68/DIG. 5; 118/419; 118/429; 118/665; 118/672

[58] Field of Search ..... 68/13 R, 22 R, 184, 68/207, DIG. 5; 8/151, 158; 162/DIG. 6, DIG. 10, 49, 238, 252; 118/665, 672, 696, 697, 419, 429

[56] References Cited

U.S. PATENT DOCUMENTS

| | | | |
|---|---|---|---|
| 3,073,153 | 1/1963 | Petitjean | 162/DIG. 6 |
| 3,172,779 | 3/1965 | Warshaw et al. | 118/672 |
| 3,190,261 | 6/1965 | Ziffer | 118/665 |
| 3,683,648 | 8/1972 | Fleissner | 118/672 X |
| 3,811,834 | 5/1974 | Schwemmer et al. | 8/158 X |
| 4,157,595 | 6/1979 | von der Eltz et al. | 8/158 X |

FOREIGN PATENT DOCUMENTS

| | | | |
|---|---|---|---|
| 0049441 | 4/1982 | European Pat. Off. | |
| 2755579 | 6/1978 | Fed. Rep. of Germany | 8/158 |
| 1389045 | 1/1965 | France . | |
| 1603914 | 6/1971 | France . | |
| 2373628 | 7/1978 | France . | |
| 2037188 | 9/1980 | United Kingdom . | |

*Primary Examiner*—Philip R. Coe
*Attorney, Agent, or Firm*—Connolly and Hutz

[57] ABSTRACT

Process and apparatus for applying in a continuous and level manner aqueous impregnating liquors to water-wet textile goods to prevent unlevelness of the liquor applied to the goods. This is accomplished by partly or completely exchanging the moisture on the goods by sucking or pressing liquor through the goods and by circulating the liquor to be applied while maintaining its volume and concentration at a constant value. The new technique makes it possible to dispense with the customary intermediate drying stage after the pretreatment.

7 Claims, 2 Drawing Figures

DEVICE FOR THE CONTINUOUS DYEING AND/OR FINISHING OF WET TEXTILE WEBS

Figure 1:
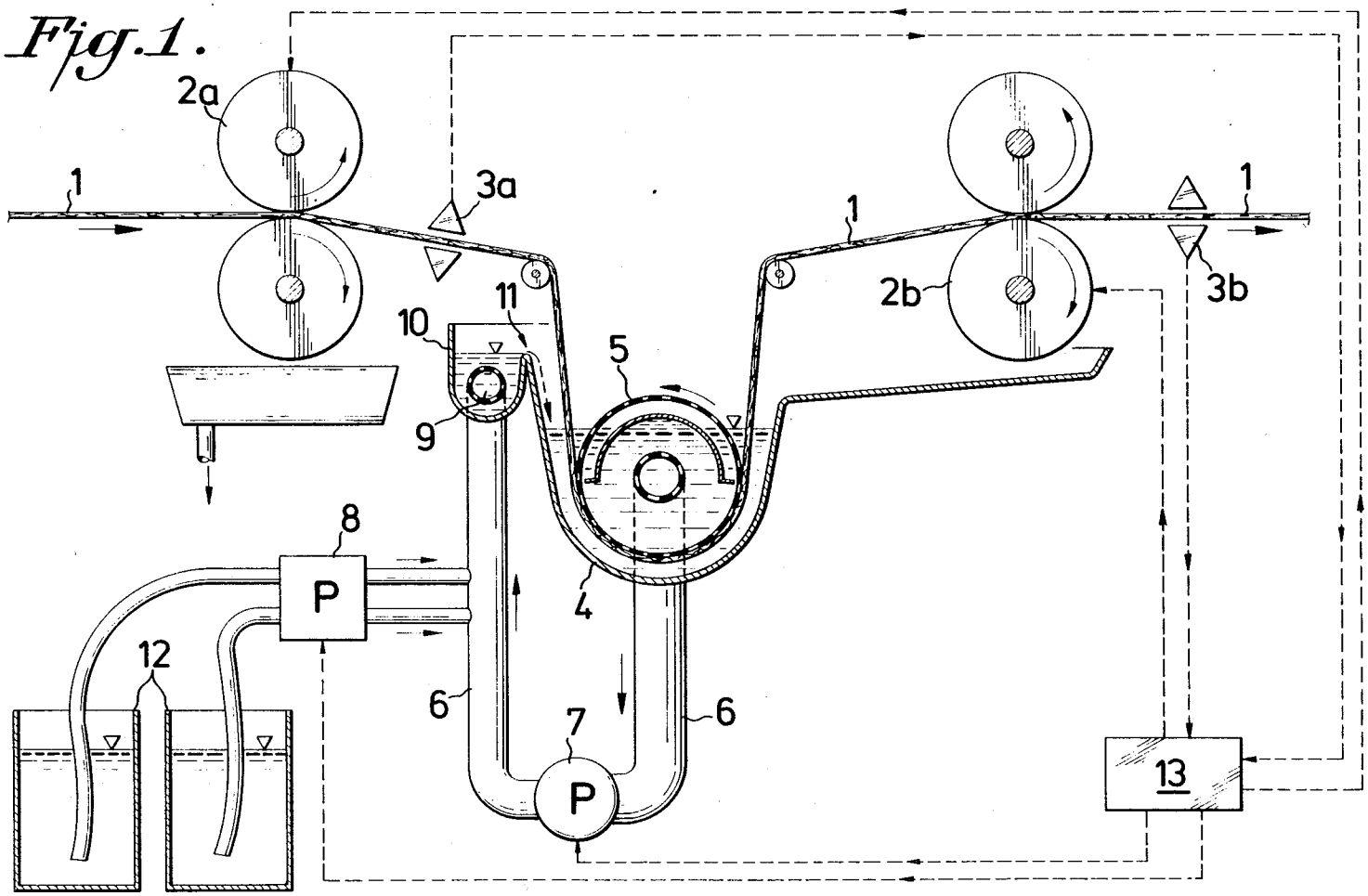

The present invention relates to a device for applying in a continuous and level manner aqueous impregnating liquors which contain at least one treatment agent to water-wet textile webs which, wet from a preceding wet-treatment, have been uniformly part-dewatered down to a certain residual moisture content, the webs' moisture content being constantly measured, in a contact-free manner along, as well as transverse to, the path of the textile goods, by a piece of equipment which comprises more than two measuring positions across the width of the web before the liquor is applied and by another such measuring arrangement after the liquor has been applied, and, in agreement with the measured values, the moisture content after a second dewatering being adjusted to be higher than that after the first dewatering. The application method according to the invention is of particular importance for the continuous dyeing and/or finishing of any kind of textile material.

Conventional industrial methods of working wet-on-wet involve two treatment liquor applicators which are connected in series, and it is customary to control the application level initially with a high-performance squeeze unit, for example on a pad-mangle, and then with a pair of rolls which has a smaller squeeze effect, so that, as a result of the difference in squeeze performance, a certain additional amount of liquid is applied.

Alternatively, it is also already known that liquid agents can be applied with perforated drums which are mounted in a dip bath and over which the web passes in open width during its pass through the liquor. Owing to the suction exerted on the textile material, This set-up ensures better penetration of the fiber material by the treatment liquid.

These two application methods have the disadvantage, however, that it proves impossible to keep the concentration of treatment agent in the liquid which is applied in the second bath at a value which is constant from the start to the end of the process. As a result of moisture carried over from the first wet-treatment step, wet-on-wet application is prone to irregular dilution effects which are strongly dependent on the speed of the textile material. There are also concentration differences across the width of the goods if there is a non-uniform squeezing action after the first padding operation. These deficiencies have hitherto virtually prevented the continuous level application of dyestuff formulations to wet webs. It is true that it is possible to treat wet goods with finishing liquors where deviations of 5 to 20% by weight from an average application level hardly have an adverse effect. However, this is merely because these finishing liquors are in the main essentially colorless substances, so that any resulting unlevelness in the finished goods is invisible to the naked eye. In contrast, the existing means and machinery were unable to provide the preconditions necessary for dyeing, neither for the measurement of moisture content values nor for controlled application of the liquor.

It is only the development of novel equipment which permits the wet-on-wet system to be reconsidered for dyeing, more accurately for applying dyestuff. Furthermore, to save on energy and costs, it has long been the wish of textile finishers to dispense with an intermediate drying stage.

It is, then, an object of the present invention to master the continuous dyeing of a uniformly wet textile material on an industrial scale and with reliable handling of the various treatment phases, in such a way that the goods are well penetrated and that there is no risk of unlevelness between the ends of the dyed textile material. Such an intention has, moreover, been given fresh impetus by the energy conservation program.

This object is achieved, in a novel manner, with a device that includes means for passing the continuously moving, moist web, immersed in an impregnating trough below the surface of the liquid, in open width over a liquor exchange unit and continuously applying the liquor evenly over the width of the web by partly or completely replacing the moisture already present on the textile material by sucking or pressing a circulating impregnating liquor through the web as well as, at the same time, ensuring that the particular predetermined quantity of impregnating liquor is absorbed by the web, whereupon the reduction in concentration of treatment agent in the liquor, due to the liquor being diluted, and the decrease in liquor volume, due to excessive absorption of liquor by the textile material, are compensated for by spent/consumed circulation liquor being strengthened or filled up by metering, into the bath, freshly prepared liquor replenishments as a function of the measured difference in liquor after the first and second dewatering.

The principle of the present invention is to monitor the moisture necessarily carried over on the wet substrate into the application process of the treatment agent and then, in the course of a pass of circulated impregnating liquor through the web guided immediately adjacently past the exchange unit, to displace the moisture there and, at the same time, replace it by impregnating liquid containing the treatment agent, the replaced moisture from the pretreatment becoming part of the impregnating liquor cycle. The danger of a progressively increasing dilution of the liquor is avoided by the novel measure of continuously metering into the bath freshly prepared liquor replenishments, which ensure that the concentration of the treatment agent is kept at a constant value and also make up for the liquor lost in the second stage as a result of an application level set at a correspondingly higher value. The use of high-moisture sensors after the dewatering and the control of the dewatering by means of measured values as well as an identical procedure following a second application of liquor enable the tolerances necessary for the uniformity of the two processes to be maintained. It is therefore possible to dispense with the customary intermediate drying stage after the pretreatment and, unlike customary practice, to apply dyeing liquors directly to wet webs.

Figure 2:
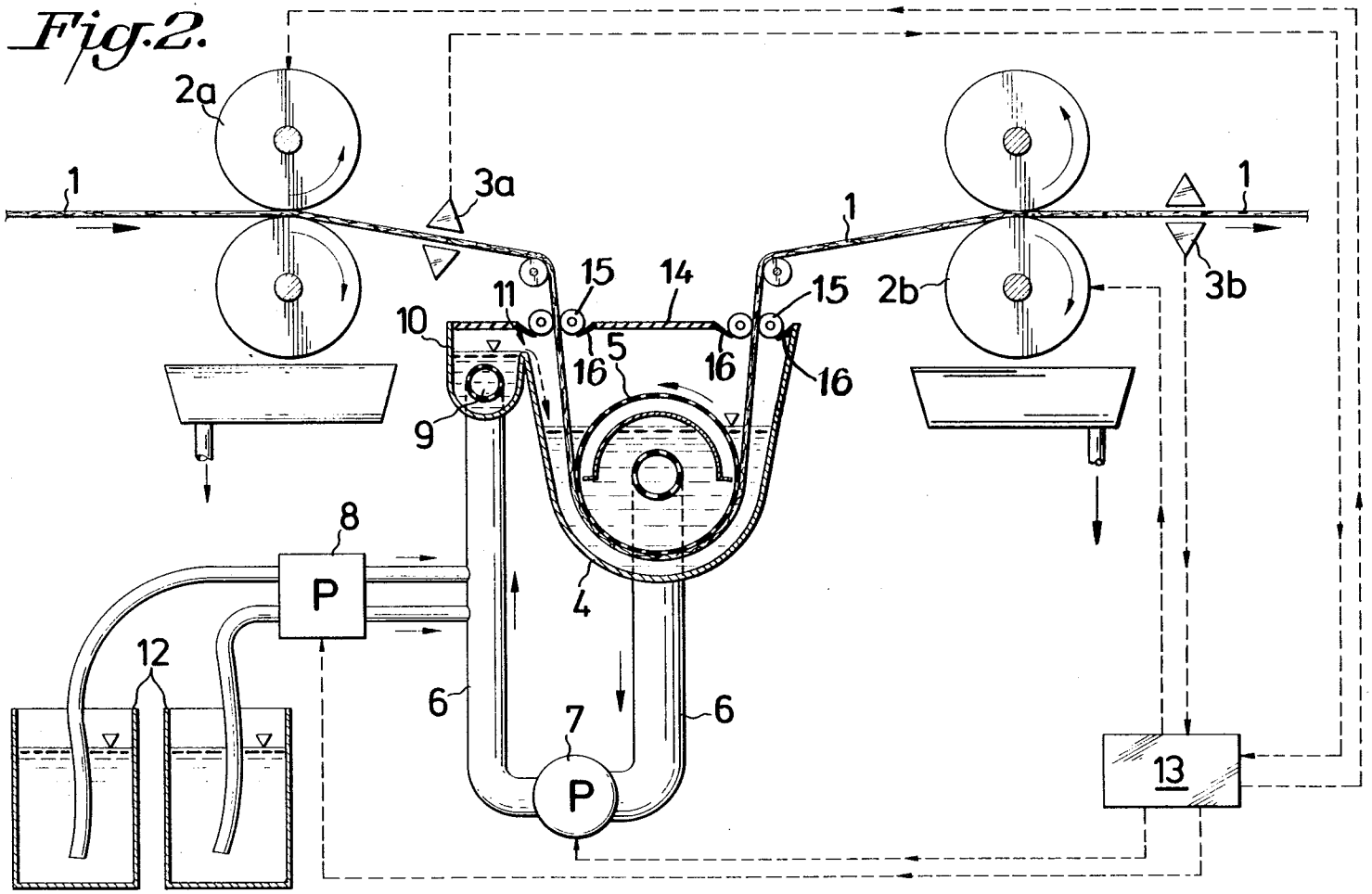

FIG. 1 is a diagrammatic side view of an apparatus according to the present invention provided with a sieve drum for liquor exchange based on suction and FIG. 2 is a diagrammatic side view similar to FIG. 1 wherein the impregnating trough is provided with a pressure-tight inlet and outlet for the web.

Specifically a suitable device essentially comprises two dewatering elements (2*a*, 2*b*) which, in the transport direction of the textile material (1), are placed one behind the other, act over the width of the web, and are both combined with a downstream piece of equipment which comprises more than two measuring positions (3*a*, 3*b*) which are distributed transversely to the transport direction of the goods to measure in a contact-free manner the entrained moisture content, or the effected liquor absorption, along and across the continuously moving web (1) after it has been dewatered shortly beforehand, wherein there is provided, between the two dewatering elements (2a, 2b) in the transport direction of the textile web (1), an impregnating trough (4) which has, below the surface of the liquid, a liquor exchange unit (5) for replacing the moisture already present on the web passed in open width over the unit (5) with impregnating liquor sucked or pressed through the web as well as, at the same time, applying the particular predetermined quantity of impregnating liquor, a pipe (6) connected thereto plus a built-in circulation pump (7) for forming a circulation system for the flowing impregnating liquor, a metering pump (8) which is connected to this pipe (6) and has feed lines for supplying the liquor cycle with freshly prepared liquor replenishments for strengthening or filling up spent/consumed circulation liquor, and, in the direction of flow below the connection for the metering pump (8), mechanical means (9) which are incorporated in the circulation system to mix spent circulation liquor with the liquor replenishments metered in.

With the device described above, the textile material (1) which has been squeezed, in a first dewatering element (2a), to a uniform moisture content is passed over a liquor exchange unit (5), for example a sieve drum or a suction slot, which dips into the impregnating liquor, which contains the treatment agent. The circulating impregnating liquor is sucked, at this point, by the action of a pump (7) through the opened-out textile material, replaces the residual moisture present on the goods or becomes diluted with this residual moisture, and, transported in a kind of circulation system, reaches a distribution box (10) which, in the direction of flow, is upstream of the actual impregnating trough (4) and is equipped with mechanically active means (9) for mixing the liquor and for ensuring that it is uniformly distributed within this system with particular attention being paid to the width of the web under treatment. The circulating impregnating liquor then passes from this box (10), the dimensions of which are determined by the width of the impregnating trough (4), over an overflow (11) which extends over the same width and uniformly distributes the liquor in the transverse direction before it finally returns into the following impregnating trough (4), where, in the pass of the goods over (5), it is sucked through the open width textile material by the pump (7), which also, at the same time, circulates the liquor. Instead of being sucked through the textile material, the impregnating liquor can, according to the invention, also be pressed through the goods to effect liquor exchange, if the liquor exchange unit (5) consists of a sieve drum under external liquor pressure and the impregnating trough (4) is provided with a pressuretight inlet and outlet for the web. It is advantageous to have excess flow of the impregnating liquor through the textile web (liquor throughput). The textile material thus treated is then nipped, sucked or wiped, in a second dewatering element, (2b) to the desired liquor pick-up, but so as to retain a higher moisture content than before entry into the impregnating bath, and is then passed on for subsequent fixing.

The moisture already present on the textile material can be evened out by means of a normal high-performance squeeze unit, preferably a pad-mangle. Immediately on leaving the dewatering element (2a) used to even out the moisture, the fiber material, which is moving with a constant speed, then has its moisture content continuously measured along and across its length by the associated measuring arrangement (3a) which comprises more than two measuring positions, and the resulting measured values are used to control the dewatering performance at the corresponding positions on the web. The moisture measurement itself is carried out in a contact-free manner using sufficiently well-known methods, for example by means of a microwave absorption moisture sensor of the type described in German Utility Model No. 7,638,683. This method gives in $g/m^2$ the water level with which the goods enter the impregnating bath. The squeeze after the impregnation is monitored by means of a measuring arrangement (3b) which is downstream of the corresponding dewatering element (2b), comprises the same equipment as the first measuring arrangement (3a) and is thus capable of continuously performing the desired monitoring function over the application of liquor. The consumption of impregnating liquor is then derived from the difference between the two moisture measurements. As required by the invention, the moisture level in respect of the second measurement (liquor absorption) at (3b) is kept at a higher value than that of the first measurement (dewatering) at (3a).

To make up the resulting difference in the moisture balance, as many freshly prepared liquor replenishments of correspondingly higher concentration in treatment agent are metered into the circulation system described above before entry of the spent impregnating liquor into the distribution box (10) upstream of the impregnating trough (4) as correspond to the liquor difference after the first and second dewatering. It is thus possible to restore to its former level not only the impregnating liquor's treatment agent concentration reduced by liquor dilution caused by the moisture exchanged and introduced into the circulation system but also the liquor volume reduced because of excess liquor pick-up by the goods. The measures necessary to accomplish this can be carried out by admixing a freshly prepared liquor replenishment, or even several of different composition in parallel and synchronously, with the spent circulation liquor or—depending on the requirements which have to be considered—by first adding a freshly prepared liquor replenishment to the circulation liquor and then, in the circulating liquor's direction of flow, after a sufficient mixing section, metering into the circulating liquor a further one or more such liquor replenishments of identical or different composition.

As already mentioned, the distribution box (10) serves to provide intimate mixing of the treatment agent formulations, in particular dyestuffs and/or chemicals, fed in from liquor replenishment or supply vessels (12) with the spent circulation liquor and then feeding in a manner which is even across the width of the liquor thus strengthened to the impregnating trough (4). The moisture content control based on the measured values at (3a) and (3b) ensures uniform consumption of impregnating liquor and hence the application to the goods of an amount of dyestuff and/or chemicals which remains constant throughout the entire treatment phase. This consumption of impregnating liquor by the textile material is opposed by the activity of the metering pump (8), in that the latter always maintains a constant concentration of dyestuff and/or chemicals in the impregnating liquor by proportionating the inflow rates, as a result of which the goods obtained are impregnated or dyed level over their length and width even when subject to varying speeds. To achieve this, the concentrated replenishment liquor contains as much dyestuff and/or chemicals as picked up by the goods from the impregnating bath.

The course of the process according to the invention can advantageously be controlled via a facility (13) such as an arithmetical processor by relating the known or measured process parameters (actual value) to the target value (for example the predetermined liquor level) and converting any difference into control signals (regulating value). Such a process makes it possible advantageously to use the liquor difference values continuously determined by the two measuring positions (3*a*) and (3*b*) for controlling the performance of the circulation pump (7), i.e. the number of times the impregnating liquor is circulated within unit time, and/or the performance of the metering pump (8), i.e. the quantities metered. The performance of the metering pump can also be controlled, on the other hand, by means of a liquor level regulator (not shown) present in the impregnating trough (4). Similarly, it is proposed to control the speed of the web as a function of the squeezing pressure of the two dewatering elements (2*a*) and (2*b*) by means of such a facility as (13).

The process of the present invention gives a very good exchange of the moisture carried over by the wet goods for the impregnating liquor containing the treatment agent. Owing to the fact that the liquor is circulated, there is always the same concentration of impregnating agents available for the application process. The penetration of the goods by the liquor ensures an even distribution of the liquor over the cross-section of the textile web, and the metering of fresh liquor formulations into the circulation system ensures that the ends of the fiber material receive the same treatment.

FIG. 2 is similiar in every respect to the apparatus of FIG. 1 except that in FIG. 2 the impregnating trough (4) is closed by means of a cap (14). Additionally, the trough has a pressure-tight inlet and a pressure-tight outlet for the web (1). Such inlet and outlet may be in the form of a roller lock (15) in cooperation with lip stuffings (16), as is well known in the art.

The new impregnating process is suitable for virtually all finishing processes, such as, for example, mercerizing, dyeing, applying any finishing chemicals, such as soft-finishes, antistats or permanent finishes, and the like.

By means of the process according to the invention, any class of dyestuff, but also other finishing agents, can be applied to textile webs made of any fiber material suitable for a continuous operation. The wet textile material to be thus treated can be in the form of woven or knitted fabric, felt, fleece, parallelized yarn, tow or tops and can consist of any kind of textile fiber. The treatment agents applied are then fixed or developed by techniques customary for the relevant products, for example by simply storing the textile material at room temperature or by steaming or hot-air treatment and other methods. The process claimed is, in this respect, thus free of any restriction.

In the case of application liquors, the sole point which should be allowed for is that restrictions can arise in respect of the solubility of various products. Such a fact should be allowed for in deciding on the application difference.

The application liquors can contain any necessary auxiliary, such as, for example, alkalis, acids, leveling aids, solubilizers and the like, again without restriction—except, in some cases, on their solubility and ionic character.

The examples which follow serve to illustrate the invention. The percentages given therein are percentages by weight, unless otherwise stated, and each of them relates, in the case of textile material, to the weight of the dry goods.

EXAMPLE 1

Causticizing moist viscose rayon fabric

A water-wet viscose rayon fabric is squeezed on a first pad-mangle to a 70% residual moisture content. The textile web is then impregnated with sodium hydroxide solution on a device according to claims 1 to 3 by passing the web in open width over a sieve cylinder which is immersed in the treatment liquid and is under suction and, at the same time, sucking an aqueous sodium hydroxide solution which contains per liter 250 g of sodium hydroxide through the moving fabric. The goods are then dewatered on a second pad-mangle to a 90% moisture content. In the course of this treatment operation, the sodium hydroxide solution sucked through has become diluted with the moisture present in the goods and is constantly restored to the use concentration of 250 g of sodium hydroxide per liter of solution by continuously metering in a replenishment liquor of highly concentrated sodium hydroxide solution. The concentration is automatically restored via a device according to claim 6. The viscose rayon fabric has then been evenly impregnated with 50 g of sodium hydroxide per kg of goods, and a very uniform caustic-shrink effect is obtained on the viscose rayon fabric.

EXAMPLE 2

Mercerizing moist cotton fabrics

The treatment operation is carried out in a manner similar to that of Example 1. A water-wet cotton poplin fabric is squeezed on the first pad-mangle to a 53% residual moisture content, and impregnated in the course of a pass through an impregnating bath with aqueous sodium hydroxide solution, the concentration of alkali in the liquor being maintained by metering in, per kg of goods, further sodium hydroxide solution containing 766 g of solid NaOH per liter of water. After squeezing on a second pad-mangle to an 80% residual moisture content, the goods are found to have a liquor pick-up corresponding to 252 g of solid NaOH per kg of goods. Immediately after the second squeeze the goods are passed into a customary mercerizing machine. A very even mercerizing effect is obtained across the length and the width of the goods.

EXAMPLE 3

Dyeing with reactive dyestuffs according to the short-time pad-batch method.

A water-wet cotton calico fabric is squeezed on a first pad-mangle to a 55% residual moisture content and then impregnated in a manner similar to that of Example 1. The impregnating bath is recharged in this example by metering in, per kg of goods, 100 $cm^3$ of a mixture which contains, per liter, 240 g of sodium chloride and 88 $cm^3$ of sodium hydroxide solution (32.5%) dissolved in water and 150 $cm^3$ of an aqueous solution which contains, per liter, 80 g of the dyestuff Reactive Blue 19, which has the C.I. No. 61,200. This gives, on the goods, a liquor level which corresponds to 12 g of dyestuff per kg of goods plus the necessary amount of fixing chemicals (24 g of sodium chloride and 8.8 $cm^3$ of 32.5% strength sodium hydroxide solution, per kg of goods) if, following the impregnating process, the goods are squeezed to an 80% residual moisture content. The textile goods thus treated are then beamed and left to stand at room temperature for 6 hours. A wash to remove excess alkali and unfixed dyestuff gives a level blue dyeing.

EXAMPLE 4

Dyeing with reactive dyestuffs according to the short-time pad-batch method

The dyeing is carried out in a manner similar to that of Example 3. A water-wet cotton calico fabric is squeezed on the first pad-mangle to a 55% residual moisture content, and the web is then passed through an impregnating bath which has a constant treatment agent concentration by the metering in, per kg of goods, 100 $cm^3$ of a mixture which contains, per liter, 400 $cm^3$ of 38° Be waterglass and 280 $cm^3$ of sodium hydroxide solution (32.5%) and 150 $cm^3$ of an aqueous solution which contains, per liter, 853 g of the dyestuff Reactive Black 5, which has the C.I. No. 20,505, in a 50% strength liquid form (=25% of pure dyestuff). In this way, sufficient liquor is applied to the goods to give a level, per kg of goods, of 128 g of dyestuff and the amount of alkali required for fixing, provided the goods are squeezed after the impregnating process to an 80% residual moisture content. The textile web thus treated is then beamed and, to fix the dyestuff, left at room temperature for 6 hours. Excess alkali and unfixed dyestuff are then washed from the dyed goods. This gives a black dyeing.

EXAMPLE 5

Dyeing with reactive dyestuffs according to the short-time pad-batch method

A water-wet mercerized cotton calico fabric is squeezed on a first pad-mangle to a 55% residual moisture content. The subsequent pass through the impregnating bath is carried out as in Example 1, constant concentration of the liquor components being ensured by metering in, per kg of goods, 100 $cm^3$ of an aqueous solution which contains, per liter, 80 g of calcined sodium carbonate and 150 $cm^3$ of an aqueous solution which contains, per liter, 53.3 g of the reactive dyestuff of the formula

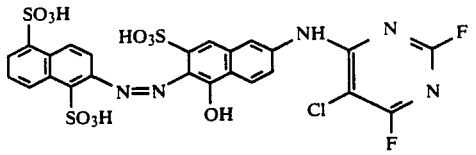

The impregnation and the subsequent second squeeze to an 80% residual moisture content ensures that the goods receive a liquor level per kg of goods which corresponds to 8 g of dyestuff and 8 g of calcined sodium carbonate, which is the amount required for fixation. The goods are then beamed and, to fix the dyestuff, left at room temperature for 10 hours. A wash to remove excess alkali and unfixed dyestuff gives an orange dyeing.

EXAMPLE 6

Dyeing with reactive dyestuffs according to the one-bath wet-steam method

The dyeing is carried out on the same piece of equipment as used in Example 1. A wet mercerized cotton calico fabric is squeezed on the first pad-mangle to a 55% residual moisture content and then dipped through an impregnating bath where a constant concentration of treatment agents is ensured by metering in, per kg of goods, 100 $cm^3$ of a mixture which contains, per liter, 240 g of sodium chloride and 96 $cm^3$ of sodium hydroxide solution (32.5%) dissolved in water and 150 $cm^3$ of an aqueous solution which contains, per liter, 106.7 g of the dyestuff Reactive Violet 5, which has the C.I. No. 18,097. In this way the goods receive, by the impregnation and the subsequent squeeze to an 80% residual moisture content, a liquor level, per kg of goods, of 16 g of dyestuff and of 24 g of NaCl and 9.6 $cm^3$ of sodium hydroxide (32.5%), which amounts are required for fixation. After the second squeeze, the web is steamed, without having been dried, in a steamer at 105° C. for 60 seconds to fix the dyestuff. The unfixed dyestuff and excess chemicals are then washed off the dyed textile web. This gives a vivid violet dyeing.

EXAMPLE 7

Dyeing with reactive dyestuffs according to the pad-roll method

A water-wet viscose rayon muslin fabric is squeezed on a first dewatering unit to a 63% residual moisture content. The cotton viscose muslin thus dewatered is then passed through an impregnating bath into which are continuously metered, per kg of goods passed through, 100 $cm^3$ of an aqueous solution which contains, per liter, 80 g of calcined sodium carbonate and 150 $cm^3$ of an aqueous solution which contains, per liter, 80 g of the dyestuff Reactive Orange 16, which has the C.I. No. 17,757. In the bath, the liquor is forced through the viscose rayon fabric with the aid of a device according to claim 4, restored to its former strength by the replenishment specified above, and returned to the impregnating trough. The impregnated goods are finally squeezed to an 88% residual moisture content, heated to 70° C. in a padroll unit to fix the dyestuff, wound up on a beam, and left at a 70° C. wet temperature and a 72° C. dry temperature for 3 hours. Excess alkali and unfixed dyestuff are then washed out of the dyed goods. This gives an orange dyeing.

EXAMPLE 8

Dyeing with solubilized vat dyestuffs:

A water-wet cotton poplin fabric is dewatered on a first dewatering machine to a 53% residual moisture content. It is then impregnated in a warm impregnating bath at 20° C. in the manner of Example 7, but, in this case, the bath is continuously recharged by metering in, per kg of goods, 200 $cm^3$ of an aqueous solution which contains, per liter, 4 g of the dyestuff Solubilized Vat Blue 6, which has the C.I. No. 69,826, 28 g of sodium nitrite and 3.5 g of sodium carbonate. This measure gives, on the goods, by the impregnating and the subsequent dewatering to a 73% residual moisture content, a treatment agent level, per kg of goods, of 0.8 g of the leuco compound, 5.6 g of sodium nitrite and 0.7 g of calcined sodium carbonate. After they have been dewatered, the impregnated goods are exposed, at room temperature for 30 seconds, to air and then dipped, to develop the dyestuff, into a warm, aqueous developing bath at 70° C. which contains, per liter, 20cm$^3$ of sulfuric acid (96%), 1 g of thiourea and 1 g of sodium 2,2'-dinaphthylmethane-6,6'-disulfonate, left therein for 2 seconds, and is then squeezed and exposed again to air for 30 seconds. After the pass in air the textile goods thus dyed are rinsed, neutralized with sodium carbonate and soaped at 98° C. for 10 minutes. This gives a pale blue dyeing.

EXAMPLE 9

Dyeing with vat dyestuffs

A water-wet bleached cotton terry fabric is squeezed on a first pad-mangle to a 60% residual moisture content, and then impregnated as in Example 1. The warm impregnating bath at 20° C. is, in this example, recharged by metering in, per kg of goods, 200 cm$^3$ of an aqueous liquor which contains, per liter, 100 g of the dyestuff Vat Red 14, which has the C.I. No. 71,110. In this way, a concentration of 20 g of dyestuff per kg of goods is applied to the goods by the impregnation and the subsequent squeeze to an 80% residual moisture content. On leaving the second padmangle, the textile web passes through a dip trough which, for vatting, contains an aqueous liquor at 20° C. holding, per liter, the chemicals 45 cm$^3$ of sodium hydroxide solution (32.5%), 23 g of concentrated sodium hydrosulfite and 30 g of calcined sodium sulfate, and the web picks up so much of this liquor to have, at the end, an overall residual moisture content of 110%, if it is passed into a steamer immediately after having been impregnated with the chemicals liquor. The impregnated web is then steamed at 102° C. for 60 seconds, and then passed for 15 seconds through a cold waterbath to rinse off. The vat dyestuff is then developed on the fiber material by oxidizing it at 50° C. with 6 cm$^3$ of hydrogen peroxide (35%) per liter of an aqueous sodium carbonate bath at pH 9.5 in the course of 30 seconds, and this is followed by soaping the dyeing thus prepared at the boil. This gives a scarlet shade on the terry fabric.

EXAMPLE 10

Dyeing with direct dyestuffs:

A water-wet bleached cotton renforce fabric is squeezed on the first pad-mangle to a 55% residual moisture content and then impregnated as in Example 1 in a warm impregnating bath at 20° C. where a constant dyestuff content in the liquor is ensured by metering in, per kg of goods, 250 cm$^3$ of an aqueous solution which contains, per liter, 10 g of the dyestuff Direct Red 81, which has the C.I. No. 28,160. In this way the impregnating and the squeeze to an 80% residual moisture content give the goods a concentration of 2.5 g of dyestuff per kg of goods. After the second squeeze, the impregnated goods are wound up on a beam and left there at room temperature for 2 hours to fix the dyestuff. Dyestuff which only adheres to the surface of the fiber is then removed by rinsing for 30 seconds with water at 30° C. on a continuous washing machine. This gives a red dyeing.

We claim:

1. A device for applying in a level manner to a continuously moving and water-wet textile web an aqueous impregnating liquor which contains at least one treatment agent, said web (1) having been uniformly part-dewatered down to a certain residual moisture content entrained from a preceding wet-treatment, the device consisting of a liquor applying equipment and two dewatering elements (2*a*,2*b*) which, in direction of the moving path of the textile web, are arranged in sequence, one of which in advance of and the other one after the said liquor applying equipment, acting over the width of the web, and are both combined with a downstream piece of equipment (3*a*,3*b*) exhibiting more than two measuring positions distributed across the width of the web to measure, in a constant and contact-free manner along, as well as transverse, the moving path of the textile material, the web's respective moisture content at the said positions, the two dewatering elements (2*a*,2*b*) and corresponding measuring devices (3*a*,3*b*) are interrelated with each other as well as the liquor applying equipment via connecting lines and focussed in a coordinating member which, based on the collected informations of the dewatering performance at the positions of 2*a* and 2*b* forwarded from the measuring equipments 3*a* and 3*b*, is continuously determining the resulting differences in the moisture balance and, in agreement with the measured values and in relation with the target value, converting into control signals to the means having a monitoring fuhction over the liquor application, to adjust the amount of the applied impregnating liquor, which comprises following up the first dewatering element (2*a*) and the sub-ordinated measuring equipment (3*a*) and prior to the second dewatering element (2*b*) and the sub-ordinated measuring equipment (3*b*) there is provided an impregnating trough (4) which has, arranged therein in a position to be immersed in the liquid, a liquor exchange unit (5) for replacing the moisture already present on the web passed in open width over the unit (5) with impregnating liquor sucked or pressed through the web as well as, at the same time, applying the particular predetermined quantity of impregnating liquor, a pipe (6) connected thereto plus a built-in circulation pump (7) for forming a circulation system for the flowing impregnating liquor, a metering pump (8) which is connected to this pipe (6) and has feed lines for supplying the liquor cycle with freshly prepared liquor replenishments for strengthening or filling up spent/consumed circulation liquor, and, in the direction of flow below the connection for the metering pump (8), mechanical means (9) which are incorporated in the circulation system to mix spent circulation liquor with the liquor replenishments metered in.

2. A device as claimed in claim 1, wherein the mechanical means (a) for mixing the liquor comprise a distribution box (10) which extends over the width of the impregnating trough and, as part of the liquor cycle, is upstream, in the direction of flow, of this trough and which is equipped with an overflow (11) of equal width into the impregnating trough (4).

3. A device as claimed in claim 1, where the liquor exchange unit (5) comprises a sieve drum which can be subjected to suction or a suction slot.

4. A device as claimed in claim 1, wherein the liquor exchange unit (5) comprises a sieve drum which can be subjected to outside liquor pressure and the impregnating trough (4) is closed by means of a cap (14) and provided with a pressure-tight inlet and outlet for the web.

5. A device as claimed in claim 1, wherein there is provided, in the impregnating trough (4), a liquor level regulator for controlling the performance of the metering pump (8).

6. A device as claimed in claim 1, wherein there is provided a facility (13) for controlling the performance of the metering pump and/or the performance of the circulation pump (7) on the basis of the liquor difference values measured by the two moisture-measuring positions (3*a*) and (3*b*).

7. A device as claimed in claim 1, wherein there is provided a facility (13) for controlling the speed of the web as a function of the squeezing pressure of the two dewatering elements (2*a*) and (2*b*).

* * * * *